US005862756A

United States Patent [19]

Gorter

[11] Patent Number: 5,862,756

[45] Date of Patent: Jan. 26, 1999

[54] INK CHAMBER DOCTOR BLADE FOR A PRINTING MACHINE

[76] Inventor: Cornelis Gorter, Naaldhof 17, 8071 AX Nunspeet, Netherlands

[21] Appl. No.: 903,715

[22] Filed: Jul. 31, 1997

[30] Foreign Application Priority Data

Aug. 2, 1996 [DE] Germany ..... 196 31 301.5

[51] Int. Cl.[6] ..... B41F 31/02

[52] U.S. Cl. ..... 101/364; 101/350.1; 101/208; 101/210

[58] Field of Search ..... 101/364, 207, 101/208, 209, 210, 350.1, 350.2, 350.3, 350.4, 350.5, 350.6, 351.1, 351.2, 351.3, 351.4, 355, 356, 360, 363, 366, 367

[56] References Cited

U.S. PATENT DOCUMENTS

| | | | |
|---|---|---|---|
| 4,414,900 | 11/1983 | Kraus et al. | 101/364 |
| 4,559,871 | 12/1985 | Kutzner et al. | 101/207 |
| 4,590,855 | 5/1986 | Schommer et al. | 101/350.6 |
| 5,243,907 | 9/1993 | Weishew | 101/364 |
| 5,253,582 | 10/1993 | Orth et al. . | |
| 5,410,961 | 5/1995 | DeNicola et al. | 101/363 |

FOREIGN PATENT DOCUMENTS

| | | |
|---|---|---|
| 0 461 426 A2 | 12/1991 | European Pat. Off. . |
| 4302671 A1 | 8/1994 | Germany . |
| A 9400988 | 2/1996 | Netherlands . |
| 2278315 | 11/1994 | United Kingdom . |

*Primary Examiner*—Edgar Burr
*Assistant Examiner*—Amanda B. Sandusky
*Attorney, Agent, or Firm*—Dehlinger & Associates

[57] ABSTRACT

An ink chamber doctor blade for a printing machine, comprising a doctor blade box (10) forming an ink chamber, at least two doctor blade knives (11, 12) attached to the doctor blade box (10) and bounding an opening (13) which, during operation, points to the outer circumference of a printing cylinder or an ink transfer roller and extends over the length of the doctor blade box (10), two front end covers (2) detachably fitted to the respective front end of the doctor blade box (10) and sealing the ink chamber, and means for supplying and discharging ink, each front end cover (2) comprising a rigid cover basic body (25) and a sealing element held by it and coming to abut against the doctor blade knives (11, 12) and against the section of the outer circumference of the printing cylinder or the ink transfer roller located between these doctor blade knives, wherein the sealing element is formed by a flat two-layer sealing plate (20), the first layer (21) of which facing the doctor blade box (10) is made of a soft-elastic flexible material and the second layer (22) of which facing away from the doctor blade box (10) is made of a low-elastic solid material, and that in mounted condition the sealing plate (20) is loaded with a first force pressing it against the front end of the doctor blade box (10) and against the front end of the doctor blade knives (11, 12) and with a second force pointing in the direction of the outer circumference of the printing cylinder or the ink transfer roller.

14 Claims, 3 Drawing Sheets

INK CHAMBER DOCTOR BLADE FOR A PRINTING MACHINE

This application claims priority to German Patent Application No. 19631301.5 filed Aug. 2, 1996, which is incorporated herein by reference.

FIELD OF THE INVENTION

The present invention relates to an ink chamber doctor blade for a printing machine, comprising a doctor blade box forming an ink chamber, at least two doctor blade knives attached to the doctor blade box and bounding an opening which, during operation, points to the outer circumference of a printing cylinder or an ink transfer roller and extends over the length of the doctor blade box, two front end covers detachably fitted to the respective front end of the doctor blade box and sealing the ink chamber, and means for supplying and discharging ink, each front end cover comprising a rigid cover basic body and a sealing element held by it and coming to abut against the doctor blade knives and against the section of the outer circumference of the printing cylinder or the ink transfer roller located between these doctor blade knives.

BACKGROUND OF THE INVENTION

Ink chamber doctor blades of the above type are commonly known from the printing technique because of their widespread use. An aspect of such ink chamber doctor blades essential to the printing trade is the sealing of the front ends of the ink chamber doctor blades against undesirable ink discharge. This involves both sealing the front end of the ink chamber formed within the ink chamber doctor blade and providing a sealing in the area of the two doctor blade knife ends and of the area of the outer circumference of the printing cylinder or the ink transfer roller located between these doctor blade knife ends, the latter sealing causing the more difficult problem. It has hitherto been conventional for known ink chamber doctor blades to close their front ends with respective rigid front end covers in the manner of a flange seal, which covers, however, leave open the section immediately adjacent to the outer circumference of the printing cylinder or the ink transfer roller. For this section an elastic plastic body is provided as a sealing element secured to the side of the front end cover pointing to the interior of the ink chamber doctor blade. The front side of the plastic body pointing to the outer circumference of the printing cylinder or the ink transfer roller is adapted to the roundness of the printing cylinder or the ink transfer roller; following this roundness are two inclined side flanks, the inclination of which is adapted to the alignment of the doctor blade knives. The rear side of the plastic body is usually straight-lined and forms a seat for securing the plastic body to the front end cover. The sealing is then effected in a manner such that the plastic body is clamped with a certain pre-tension between the front end cover securing it and the doctor blade knives abutting against its side flanks. In view of its elasticity the plastic body adapts itself to the surfaces of the doctor blade knives pointing to the interior of the ink chamber, and the plastic body adapts itself to the outer circumference of the printing cylinder or the ink transfer roller. Practical experience, however, has shown that, in operation, this adaptation will last only for a limited time; for after a certain operating time ink will penetrate and move on the side flank of the plastic body in the direction of rotation of the printing cylinder or the ink transfer roller, which ink will be thickened through the heat developing as a result of the friction between printing cylinder or ink transfer roller and plastic body and will collect more and more in the increasingly widening slot space between the side flank of the plastic body and the interior of the doctor blade. Moreover, the wear of the plastic body in its area of contact with the printing cylinder or the ink transfer roller cannot be effectively compensated, because the doctor blade knives prevent the plastic body from moving towards the printing cylinder or the ink transfer roller. Consequently, in this area the plastic body loses its sealing effect, and ink will gradually discharge to an increasing extent from the interior of the ink chamber outwards. Such ink discharge is undesirable and is partially even detrimental to the quality of the printed products or the usability of the printing machine. To avoid ink discharge, the plastic body must be replaced at relatively short intervals, which requires respective interruptions of the printing process and partial disassembly of the ink chamber doctor blade, which can only be done after preceding removal of the ink from the ink chamber. Finally, it is a drawback that the plastic body, through the forces exerted by its inclined side flanks on the interior of the doctor blade knives, pushes the latter out of their straight-line course. This deviation of the doctor blade knives from the desired straight-line course gives an enlarged doctor blade slot in the area of the doctor blade ends and thus leads to an increase in the ink supplied thereto in this section of the printing cylinder or the ink transfer roller. This gives irregular ink saturation in subsequent printing, which means a deterioration.

SUMMARY OF THE INVENTION

The object of the invention is therefore to provide an ink chamber doctor blade of the above-mentioned type which no longer has the above drawbacks and particularly gives improved seal at its front ends, thus enabling longer periods of use free of interruptions and without ink leakage, and in which a constantly regular ink supply is guaranteed. Furthermore, a replacement of the sealing element, if required, must be realized quickly and easily.

According to the invention this object is achieved by means of an ink chamber doctor blade of the above-mentioned type, which is characterized in that the sealing element is formed by a flat two-layer sealing plate, the first layer of which facing the doctor blade box is made of a soft-elastic flexible material and the second layer of which facing away from the doctor blade box is made of a low-elastic solid material, and that in mounted condition the sealing plate is loaded with a first force pressing it against the front end of the doctor blade box and against the front end of the doctor blade knives and with a second force pointing in the direction of the outer circumference of the printing cylinder or the ink transfer roller.

In the ink chamber doctor blade according to the invention the seal is advantageously applied not only to the front end of the doctor blade box but also to the front end of the doctor blade knives. To this end, the doctor blade box and the doctor blade knives are effectively aligned with each other at their ends so as to avoid disturbing stages in the sealing area. This excludes every risk that through a wedging effect displaced ink may form a slot space between the inside of one doctor blade knife and the adjacent areas of the sealing element. The first layer of the sealing plate made of a soft-elastic flexible material further ensures that the sealing plate all together remains mobile to a certain extent relative to the doctor blade box and the doctor blade knives, without causing a loss of sealing function. This mobility is particularly used to move the sealing plate in the direction of its plane towards the outer circumference of the printing cylinder or the ink transfer roller, so that automatic readjustment is constantly realized, also in case of gradual wear of the front edge area of the sealing plate abutting against the outer circumference of the printing cylinder or the ink transfer roller. The second layer of solid material arranged next to the first layer provides adequate stability of shape and the necessary capacity of taking up forces. Since, moreover, the sealing plate exerts practically no forces on the doctor blade knives moving them out of their desired position, a very regular ink supply is guaranteed, also at the ends of the doctor blade knives. For this reason the wear of the doctor blade knives further develops quite regularly, so that this also contributes to a long undisturbed period of use with a constantly satisfactory printing result.

A first preferred embodiment of the sealing plate of the ink chamber doctor blade provides that the first layer and the second layer of the sealing plate are plate-shaped with a substantially corresponding outline.

An embodiment of the sealing plate of the ink chamber doctor blade alternative in this respect provides that the second layer of the sealing plate is plate-shaped and that the first layer of the sealing plate is strip- or strand-shaped and arranged on the second layer corresponding to the contour of the ink chamber of the doctor blade box and the contour of the front ends of the doctor blade knives. In this second embodiment of the sealing plate particularly inexpensive material can be used for the first layer of the sealing plate, and if required, simple replacement of the first layer is possible. If such replacement is provided, the first layer is preferably clamped in a groove provided in the second layer, so that it is possible without further auxiliary means to detach it and place a new first layer.

A very suitable material for the first layer of the sealing plate is a foam having closed cells or a soft rubber, since these materials, on the one hand, have the necessary flexibility and elasticity and, on the other hand, retain the desired sealing effect, also in case of small relative movements between the sealing plate and the doctor blade box as well as the doctor blade knives.

The material for the second layer of the sealing plate is preferably a solid plastic, since this is suitable for taking up the forces necessary for the function of the sealing plate, and since it can additionally be brought into sliding contact therewith without damaging the outer circumference of the printing cylinder or the ink transfer roller.

The two layers of the sealing plate are effectively connected together via their total area of contact, for instance by adhesion or welding or, particularly in case of the strip- or strand-shaped first layer, embedded in each other, which results in a practically integral structural member.

It is further provided that at its edge pointing to the outer circumference of the printing cylinder or the ink transfer roller the sealing plate has a circular segment-shaped contour adapted to the radius of the outer circumference, along which contour, in the new state of the sealing plate, its first layer slightly projects relative to the second layer. By means of this embodiment of the sealing plate it is achieved that from the beginning a reliable seal between the sealing plate and the outer circumference of the printing cylinder or the ink transfer roller is obtained, also when the solid layer of the sealing plate has not yet completely adapted itself by grinding to the exact contour of the outer circumference of the printing cylinder or the ink transfer roller. With increasing operation time the solid layer of the sealing plate adapts itself increasingly more exactly to the circumferential surface of the printing cylinder or the ink transfer roller, so that this can more and more adopt the sealing function, also when, parallel thereto, the soft-elastic flexible layer of the sealing plate is already subjected to wear. This also contributes to a long service life of the sealing plate.

A further embodiment of the ink chamber doctor blade provides that in its second layer, beside one or beside both doctor blade knives, the sealing plate has, outside the ink chamber contour, (respectively) a recess which is concave through semicircular starting from the circular segment-shaped contour. This recess serves to form a receptacle for smaller ink quantities which, during operation of a printing machine, arrive between the outer circumference of the printing cylinder or the ink transfer roller and the front edge of the sealing plate abutting against it. The heat developing as a result of the locally occurring friction causes the volatile constituents of the ink to vaporize, following which the solid substances and the difficult volatile portions of the ink are left and assume a pasty condition. The edge of the recess, towards which the printing cylinder or the ink transfer roller runs during operation, is a kind of scraper, which takes the pasty ink from the surface of the printing cylinder or the ink transfer roller and collects it in the recess. Since in view of the improved seal only small ink quantities can pass, it suffices during operation of the associated printing machine to occasionally take away the locally accumulated pasty ink.

To improve the cohesion between the first and the second layer of the sealing plate, the first soft-elastic layer of the sealing plate in its non-sealing surface area pointing to the interior of the doctor blade box can be covered with a third solid layer. This embodiment renders it possible to clamp the first soft-elastic layer between the solid second and the solid third layer. Connecting means, such as rivets or screws, fixing the two solid layers together with interposition of the soft-elastic first layer, can be suitably used, so that in this case areal adhesion or welding between the first and the second layer can be omitted.

To enable the above-mentioned forces necessary for the function of the sealing plate to be exerted thereon as simply as possible, it is provided that the cover basic body shows a flat pressing surface facing the second layer of the sealing plate as well as a pressing ridge engaging behind the second layer of the sealing plate at its edge facing away from the printing cylinder or the ink transfer roller. The thus formed sealing plate is thus capable of transferring to the sealing plate both a force acting in a direction vertical to the plane of the sealing plate and a force acting in the direction of the plane of the sealing plate towards the printing cylinder or the ink transfer roller, yet retaining a simple form of the cover basic body.

To guarantee a reliable function of the ink chamber doctor blade, particularly of its seals, with minor technical resources, it is further proposed that the first and the second force can be provided by a respective spring arrangement. The spring arrangements can be formed by one or several springs, and the forces can be adjusted to the desired values by selection of suitable springs. The spring arrangements may be, for instance, mechanical or pneumatic or hydraulic springs.

To enable compensation of tolerances of manufacture and properties of the sealing plate or further involved structural members of the ink chamber doctor blade, the spring arrangements can be adjustable with regard to the forces exerted by them, for instance by adjustment of their pretension by means of adjusting screws or by modification of a pneumatic or hydraulic pressure.

With regard to the position and accommodation of the spring arrangements there are two preferred possibilities. The first possibility consists in that the cover basic body is subdivided into two body parts connected via one of both or via both spring arrangements, one body part retaining the sealing plate and the other being detachably connected to the doctor blade box.

A second possibility is that one of both or both spring arrangements is/are provided between the cover basic body and the doctor blade box or parts rigidly connected thereto.

To enable the front end cover and the associated sealing plate to be arranged at the front ends of the ink chamber doctor blade as quickly and simply as possible, it is proposed that at each front end of the doctor blade box a sliding guide is provided for taking up and retaining a respective front end cover, into which the front end cover can be slid when the doctor blade box has been removed from the printing cylinder or the ink transfer roller from its side facing the printing cylinder or the ink transfer roller. In the simplest case, the front end cover can thus only be finished by removing the ink chamber doctor blade from the associated printing cylinder or from the associated ink transfer roller. When during removal of the ink chamber doctor blade from the printing cylinder or the ink transfer roller it is desirable that the seal of the front ends of the ink chamber remains intact, the sliding guide may also show an additional barrier or obstacle which only after its separation allows withdrawal of the front end cover from the sliding guide.

An ink chamber doctor blade according to the prior art and an example of embodiment according to the invention will hereinafter be illustrated with reference to the accompanying drawings.

DETAILED DESCRIPTION OF THE INVENTION

Figure 1:
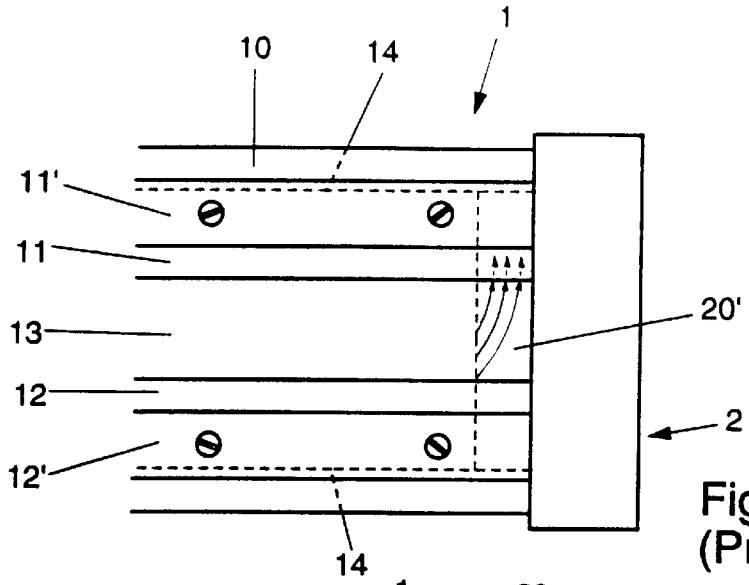
Fig.1 (Prior art)
FIG. 1 is a view of the end section of an ink chamber doctor blade according to the prior art.

In the drawings FIG. 1 is a view of the right-hand end section of an ink chamber doctor blade 1 as known from the prior art. The ink chamber doctor blade 1 mainly consists of a doctor blade box 10 forming the periphery of the ink chamber doctor blade 1. In the interior of the doctor blade box 10 an ink chamber is formed, the contour of which is indicated by means of dotted lines having the reference numeral 14. In the middle of the side of the ink chamber doctor blade 1 facing the viewer an opening 13 is visible which extends over the total length of the doctor blade box 10. This opening serves to supply ink to the circumferential surface of a printing cylinder or an ink transfer roller not shown. At the top and the bottom the opening 13 is bounded by a doctor blade knife 11, 12, which is detachably connected, here screwed, to the doctor blade box 10 by means of retaining strips 11', 12'. Alternatively, clamping of the doctor blade knives 11, 12 is possible.

At the right-hand front end of the ink chamber doctor blade 1, visible in FIG. 1, a front end cover 2 is placed against the front end of the doctor blade box 10 by way of a flange. Furthermore, the front end cover 2 comprises a sealing element 20', which is arranged near the end of the two doctor blade knives 11, 12 behind them inside the ink chamber 14. The visible part of the sealing element 20', facing the viewer, formed by an elastic plastic body, has a roundness adapted to the outer circumference of the printing cylinder or ink transfer roller. From the ends of this rounded section the sealing element 20' with two inclined flank sections runs parallel to the rear side of the doctor blade knives 11, 12. As indicated by arrows at the visible part of the sealing element 20', ink is worked into the interspace between the outer circumference of the printing cylinder or ink transfer roller, on the one hand, and the front end of the sealing element 20', abutting against the outer circumference, on the other hand, which is done by means of rotation of the printing cylinder or the ink transfer roller, in the present example in the section of contact with the ink chamber doctor blade from the bottom to the top. As indicated by dotted arrows, this ink arrives in the slot space between the upper inclined flank of the sealing element 20', and the rear side of the upper doctor blade knife 11, where through the frictional heat and the resulting vaporization of the light volatile ink components pasty ink accumulations are formed which, through a wedging effect, decrease the sealing function of the sealing element 20' and finally lead to undesirable ink leakage.

Figure 2:
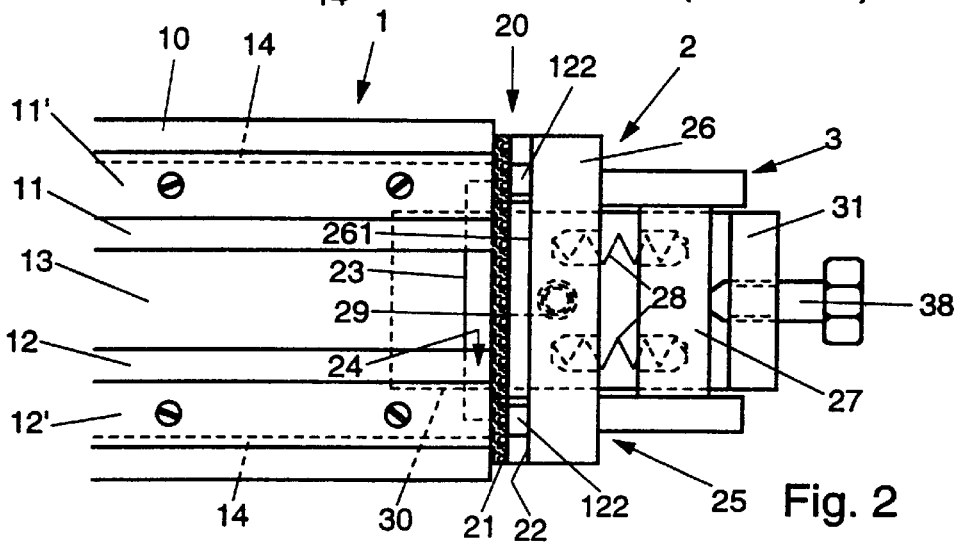
FIG. 2 is a view of the front side of an ink chamber doctor blade according to the invention, facing a printing cylinder or an ink transfer roller.

FIG. 2 of the drawings shows an ink chamber doctor blade 1, the construction of which substantially corresponds to the ink chamber doctor blade 1 of FIG. 1, but which is now provided with another front end cover 2.

Also in respect of the ink chamber doctor blade 1 of FIG. 2 the opening 13 for the ink transfer to the printing cylinder or the ink transfer roller faces the viewer. Towards the top and the bottom the doctor blade knives 11, 12 and their retaining strips 11', 12' connect. Here, too, the doctor blade box 10 forms the periphery of the ink chamber doctor blade 1, in which doctor blade box 10 the ink chamber 14 is positioned.

The front end cover 2 of the ink chamber doctor blade 1 of FIG. 2 mainly consists of a cover basic body 25 and a sealing plate 20 held by this body. The sealing plate 20 consists of two different layers, namely a first layer of a soft-elastic flexible material facing the doctor blade box 10 and a second layer 22 of a low-elastic solid material facing away from the doctor blade box. The surface extension of the sealing plate 20 is so chosen as to reliably cover at least the ink chamber 14 with an adequate projection length. The sealing plate 20 must not project beyond the outer contour of the doctor blade box 10.

In the present example of embodiment the cover basic body 25 is subdivided into two body parts 26, 27, which are movable relative to each other and between which is arranged a first spring arrangement 28, here consisting of several coil springs. The first body part 26 has a flat pressing surface 261, with which it abuts against the flat side of the sealing plate 20, to be more exact: of its second layer 22, facing this body part.

On the rightmost side of FIG. 2 a sliding guide 3 is indicated which is rigidly connected, in the background invisibly, to the rear side of the doctor blade box 10. Through the visible second leg 31 of the sliding guide 3 extends a pre-tensioning screw 38, which, with its front end, abuts against the second body part 27. By adjusting this pre-tensioning screw 38 the force exerted by the spring arrangement 28 on the first body part 26 of the cover basic body 25 can be adjusted. Thus, in the mounted condition of the front end cover 2 a force is exerted on the sealing plate 20 which presses it towards the front end of the doctor blade box 10 and the front end of the two doctor blade knives 11, 12. Thus the desired seal of the ink chamber towards the outside is realized.

Simultaneously, the sealing plate 20 with its front end facing the viewer in FIG. 2 provides a seal against the outer circumference of the associated printing cylinder or the associated ink transfer roller not shown. The sealing plate 20 suitably has at its front end facing the viewer in FIG. 2 a circular segment-shaped contour adapted to the circumferential radius of the printing cylinder or ink transfer roller. By a second force the sealing plate 20 is pressed towards the associated printing cylinder or the associated ink transfer roller, for which purpose a further spring 29 is arranged behind the first body part 26 of the cover basic body 25, which spring 29 is supported with its other end on the first leg 30 of the sliding guide 3 located in the background.

Figure 3:
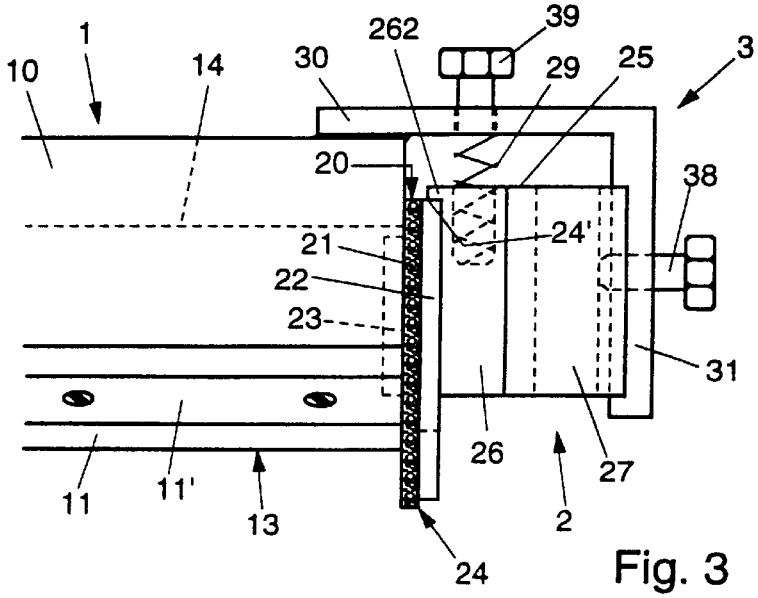
FIG. 3 is a top plan view of the ink chamber doctor blade of FIG. 2.

The arrangement of the second spring 29 and its function are very clearly visible in FIG. 3. The viewer's eye now falls on the side of the ink chamber doctor blade 1 located upwards in FIG. 2 with its ink chamber 10. Visible at the lower edge of FIG. 3 is the upper doctor blade knife 11 with its retaining strip 11', followed downwards by the opening 13.

Rigidly connected to the doctor blade box 10 is the sliding guide 30, which is L-shaped in top plan view. Its first leg 30 is rigidly connected to the rear side of the doctor blade box 10. Through this first leg 30 extends a second pre-tensioning screw 3 serving to adjust the initial tension in the second spring 29 which, in the direction of the plane of the sealing plate 20, acts on it via the first body part 26 of the cover basic body 25. The first body part 26 of the cover basic body 25 is suitably formed with a pressing ridge 262 at its top edge, left-hand in FIG. 3, which pressing ridge 262 engages behind the rear front edge of the second layer 22 of the sealing plate 2 abutting against this element.

The circular segment-shaped contour 24 of the sealing plate 20, described before with reference to FIG. 2, now points downwards in FIG. 3.

In addition to the first and second layers 21, 22 the sealing plate 20 may comprise a third layer 23 which, in FIG. 2, is partly visible through the opening 13 and which, in FIG. 3, is entirely covered and therefore drawn in dotted lines only. The third layer 23 preferably consists, like the second layer 22, of a solid material but extends only over the non-sealing section of the surface of the first layer 21 of the sealing plate 20 pointing to the doctor blade box 10. As a result, the first layer 21 is protected especially against premature detachment from the second layer 22, and moreover, the first layer 21 can be clamped between the two other layers by means of connecting members extending through the second and the third layer.

In FIG. 2 the reference numeral 122 denotes two recesses in the front edge of the second layer 22 of the sealing plate 20 facing the viewer in FIG. 2,—which serve to receive small amounts of ink that may have been rubbed through the seal notwithstanding. Their exact position and contour is shown in FIGS. 4 and 5 in more detail.

Figure 4:
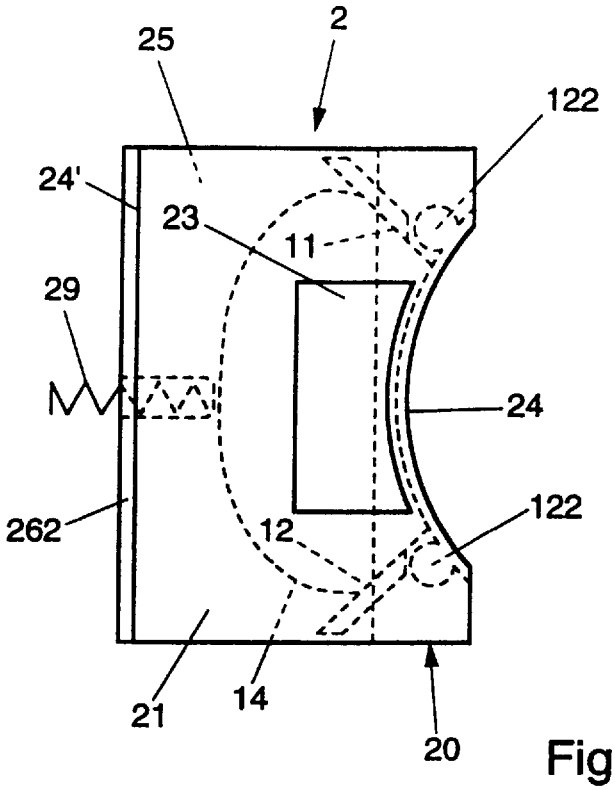
FIG. 4 is a view of the flat side of a front end cover of the ink chamber doctor blade of FIG. 2 and FIG. 3, facing the doctor blade box of the ink chamber doctor blade, in dismounted condition.
Figure 5:
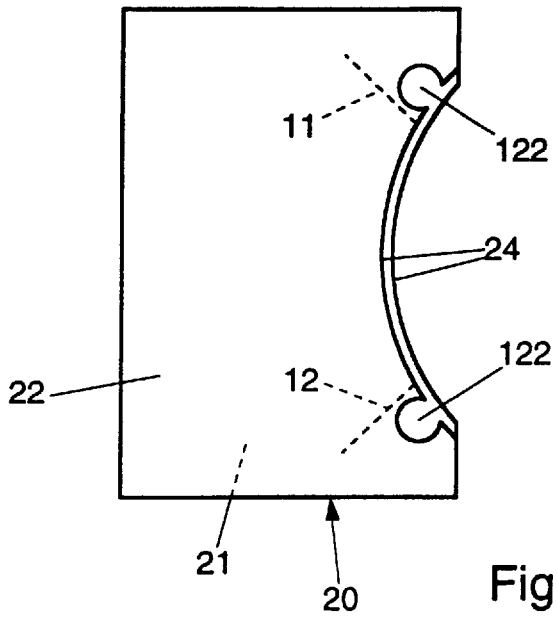
FIG. 5 is a view of a flat side of a sealing plate forming part of the front end cover of FIG. 4, facing away from the doctor blade box.

FIG. 4 of the drawings shows the front end cover 2 of FIGS. 2 and 3 in a condition dismounted from the doctor blade box 10 of the ink chamber doctor blade 1, and in FIG. 4 the side of the front end cover 2 pointing to the doctor blade box 10 in mounted condition faces the viewer. Thus the first layer 21 of the sealing plate 20 which, as very clearly shown in FIG. 4, shows a rectangular basic form faces the viewer. The front edge of the sealing plate 20 pointing in FIG. 4 to the right is formed for adaptation to a printing cylinder not shown or an ink transfer roller having the circular segment-shaped contour 24. The other front edges of the sealing plate 20 extend along a straight line. The front edge 24' of the sealing plate 20, left-hand in FIG. 4, is engaged by the pressing ridge 262 of the first body part 26 of the cover basic body 25 covered by the sealing plate 20. Behind the pressing ridge 262 the free end of the second spring 29 extends outwards.

Furthermore, in FIG. 4 the viewer's eye falls on the third layer 23 of the sealing plate 20, and it is clearly visible that the third layer 23 extends only over the non-sealing section of the first layer 21 of the sealing plate 20. The sealing section of the first layer 21 extends along a dotted line indicated by reference numeral 14, which line represents the periphery of the ink chamber. Moreover, the first layer 21 seals against the front ends of the doctor blade knives 11, 12, the position of which relative to the sealing plate 20 is also indicated by dotted lines provided with reference numerals 11 and 12.

Finally, it can be derived from FIG. 4 that in the area of the circular segment-shaped contour 24 the first layer 21 of the sealing plate 20 opposite the second layer 22, which is in the background here, projects a little outwards. This projecting length, which is excessively magnified in the drawings, in reality ranges from 0.1 to 0. 3 mm, which size is material-dependent.

Near the end of the circular segment-shaped contour 24 one of the recesses 122 is indicated by dotted lines at the top and the bottom, since these recesses 122 are provided only in the covered second layer 22 of the sealing plate 20.

FIG. 5 of the drawings shows the sealing plate 20 only from the side pointing backwards. In FIG. 5 the viewer's eye therefore falls on the flat side of the second layer 22; the first layer 21 of soft-elastic material now points downwards.

In FIG. 5 the position of the doctor blade knives 11, 12 is also indicated by dotted lines with reference numerals 11, 12. It will be very clear that the two recesses 122, now directly visible, are located outside the area of the circular segment-shaped contour 24 bounded by the doctor blade knives 11, 12.

Figure 6:
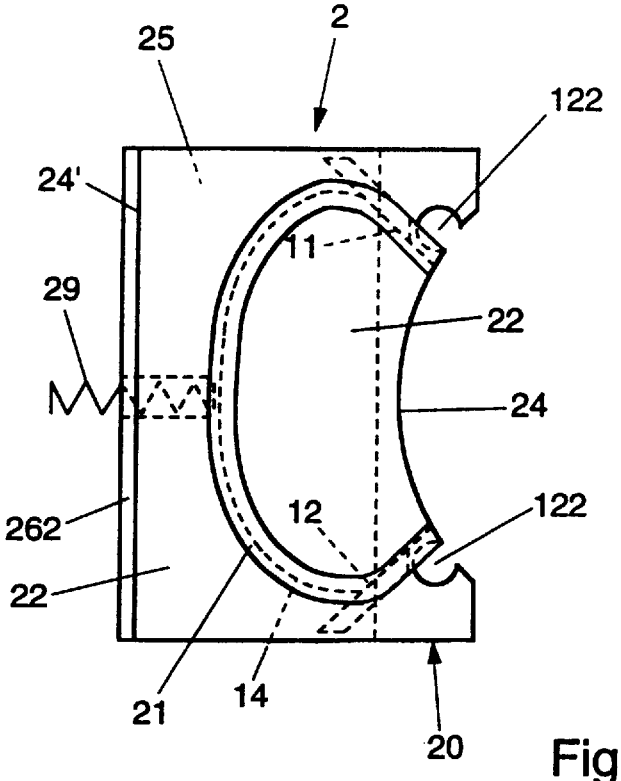
FIG. 6 is a modified front end cover as shown in FIG. 4.

Finally, FIG. 6 of the drawings shows the same view as FIG. 4 of a modified embodiment of the sealing plate 20. Unlike the example of embodiment of FIG. 4, only the second layer 22 is plate-shaped in the sealing plate 20 of FIG. 6, whereas the first layer 21 is arranged in the form of a strip on the second layer 22. The course of the first layer 21 is adapted to the contour 14 of the ink chamber and to the contour of the doctor blade knives 11, 12, which are each indicated by dotted lines. Thus a relatively inexpensive strip- or strand-shaped material "from the roll" can be used for the first layer 21, which is particularly cost-saving when the first layer 21 must often be renewed. The first layer 21 is either adhered to the second layer 22 or in the surface of the second layer 22 facing the viewer in FIG. 6 is provided a groove in which the first layer 21 is placed, preferably clamped. Particularly suited for such clamping is an undercut groove, for instance a dovetail groove or a T groove. In its other parts the sealing plate 20 of FIG. 6 corresponds to that of FIG. 4; for the further reference numerals reference is therefore made to the description of FIG. 4.

Although the invention has been described with respect to particular embodiments, it will be apparent to those skilled in the art that various changes and modifications can be made without departing from the invention.

It is claimed:

1. An ink chamber doctor blade for a printing machine, comprising a doctor blade box (10) forming an ink chamber, at least two doctor blade knives (11, 12) attached to the doctorblade box (10) and bounding an opening (13) which, during operation, points to the outer circumference of a printing cylinder or an ink transfer roller and extends over the length of the doctor blade box (10), two front end covers (2) detachably fitted to the respective front end of the doctor blade box (10) and sealing the ink chamber, and means for supplying and discharging ink, each front end cover (2) comprising a rigid cover basic body (25) and a sealing element held by it and coming to abut against the doctor blade knives (11, 12) and against the section of the outer circumference of the printing cylinder or the ink transfer roller located between these doctor blade knives, characterized in that the sealing element is formed by a flat two-layer sealing plate (20), the first layer (21) of which facing the doctor blade box (10) is made of a soft-elastic flexible material and the second layer (22) of which facing away from the doctor blade box (10) is made of a low-elastic solid material, and that in mounted condition the sealing plate (20) is loaded with a first force pressing it against the front end of the doctor blade box (10) and against the front end of the doctor blade knives (11, 12) and with a second force pointing in the direction of the outer circumference of the printing cylinder or the ink transfer roller.

2. An ink chamber doctor blade according to claim 1, characterized in that the first layer (21) and the second layer (22) of the sealing plate (20) are plate-shaped with a substantially corresponding outline.

3. An ink chamber doctor blade according to claim 1, characterized in that the second layer (22) of the sealing plate (20) is plate-shaped and that the first layer (21) of the sealing plate (20) is strip- or strand-shaped and arranged on the second layer (22) corresponding to the contour of the ink chamber of the doctor blade box (10) and the contour of the front ends of the doctor blade knives (11, 12).

4. An ink chamber doctor blade according to claim 1, characterized in that the material forming the first layer (21) of the sealing plate (20) is a material selected from the group consisting of a foam having closed cells and a soft rubber.

5. An ink chamber doctor blade according to claim 1, characterized in that the material forming the second layer (22) of the sealing plate (20) is a solid plastic.

6. An ink chamber doctor blade according to claim 1, wherein the sealing plate (20), along its edge pointing to the outer circumference of the printing cylinder or the ink transfer roller, has a circular segment-shaped contour (24) adapted to the radius of the outer circumference, and along such contoured edge the first layer (21) of the sealing plate (20) slightly projects relative to the second layer (22).

7. An ink chamber doctor blade according to claim 6, characterized in that in its second layer (22), beside one or beside both doctor blade knives (11, 12), the sealing plate (20) has, outside the ink chamber contour (14), a recess (122) which starts from the circular segment-shaped contour (24) and has a concave to semi-circular shape.

8. An ink chamber doctor blade according to claim 1, characterized in that the first layer (21) of the sealing plate (20) in its non-sealing surface area pointing to the interior of the doctor blade box (10) is covered with a third solid layer (23).

9. An ink chamber doctor blade according to claim 1, characterized in that the cover basic body (25) has a flat pressing surface (261) facing the second layer (22) of the sealing plate (20) as well as a pressing ridge (262) engaging behind the second layer (22) of the sealing plate (20) at its edge (24') facing away from the printing cylinder or the ink transfer roller.

10. An ink chamber doctor blade according to claim 1, characterized in that the first and the second force are provided by a respective spring arrangement (28, 39).

11. An ink chamber doctor blade according to claim 10, characterized in that the spring arrangements (28, 39) are adjustable with regard to the forces exerted by them.

12. An ink chamber doctor blade according to claim 10, characterized in that the cover basic body (25) is subdivided into two body parts (26, 27) connected via at least one spring arrangement (28, 29), one body part (26) retaining the sealing plate (20) and the other body part (27) being detachably connected to the doctor blade box (10).

13. An ink chamber doctor blade according to claim 10, characterized in that at least one spring arrangement (28, 29) is provided between the cover basic body (25) and the doctor blade box (10).

14. An ink chamber doctor blade according to claim 1, characterized in that at each front end of the doctor blade box (10) a sliding guide (3) is provided for taking up and retaining a respective front end cover (2), into which the front end cover (2) can be slid when the doctor blade box (10) has been removed from the printing cylinder or the ink transfer roller from its side facing the printing cylinder or the ink transfer roller.

* * * * *